US006165112A

United States Patent [19]

Morris

[11] Patent Number: 6,165,112

[45] Date of Patent: Dec. 26, 2000

[54] COLLAPSIBLE KNEE EXERCISE DEVICE

[76] Inventor: Lawrence P. Morris, 7877 N. Gregory Rd., Fowlerville, Mich. 48336

[21] Appl. No.: 09/093,360

[22] Filed: Jun. 8, 1998

Related U.S. Application Data

[60] Provisional application No. 60/049,202, Jun. 9, 1997.

[51] Int. Cl.[7] ..... A63B 26/00

[52] U.S. Cl. ..... 482/142; 482/38; 482/129; 482/140; 482/908

[58] Field of Search ..... 482/148, 129, 482/910, 142, 908, 38, 907, 143, 140, 14, 23, 141, 145

[56] References Cited

U.S. PATENT DOCUMENTS

| | | | |
|---|---|---|---|
| 3,944,219 | 3/1976 | LoPresti | 272/62 |
| 4,634,119 | 1/1987 | Pesthy | 272/144 |
| 4,822,031 | 4/1989 | Olschewski | 272/71 |
| 5,033,734 | 7/1991 | Jalbert | 272/70 |
| 5,074,549 | 12/1991 | Harvey | 272/93 |
| 5,290,209 | 3/1994 | Wilkinson | 482/38 |
| 5,336,152 | 8/1994 | Winslow et al. | 482/132 |
| 5,389,055 | 2/1995 | Gangloff | 482/38 |
| 5,586,962 | 12/1996 | Hallmark | 482/129 |
| 5,871,424 | 2/1999 | Conner | 482/129 |

*Primary Examiner*—Stephen R. Crow
*Assistant Examiner*—Tam Nguyen
*Attorney, Agent, or Firm*—Charles W. Chandler

[57] ABSTRACT

A person's leg muscles can be strengthened with a leg-support cross piece adapted to underlie the person's knee joint while the person lies with his back on a floor surface. The lower portion of the leg is swung up and down around the supported knee joint to exercise the leg muscles. An elastic strap type resistance unit may be extended from the framework that supports the cross piece for partial encirclement of the person's ankle, to increase the effort involved in swinging the leg.

2 Claims, 3 Drawing Sheets

COLLAPSIBLE KNEE EXERCISE DEVICE

CROSS REFERENCE TO RELATED PATENT APPLICATION

This is a continuation-in-part of my co-pending provisional patent application filed in the United States Patent Office on Jun. 9, 1997, Ser. No. 60/049,202, titled COLLAPSIBLE KNEE EXERCISE DEVICE.

BACKGROUND OF THE INVENTION

Patients undergoing therapeutic treatment after a leg or knee operation, are frequently placed with their back on the floor and their legs raised. A supporting device is disposed on the underside of the knee. The outer extremity of the leg is then exercised to restore the bending capability of the knee.

Physical therapists who perform this treatment travel from patient to patient and therefore need a supporting device that can be readily transported between patients.

Some related prior art includes U.S. Pat. No. 5,074,549 which issued Dec. 24, 1991 to Clyde R. Harvey for a "Knee Exercise Device"; U.S. Pat. No. 4,822,031 which issued Apr. 18, 1989 to Horst A. Olschewski for "Pool Exercise Device"; and U.S. Pat. No. 5,389,055 which was issued Feb. 14, 1995 to Robert B. Gangloff for a "Portable Exercise Bar Device". Gangloff shows a hinged support used for performing pull-ups or chin-ups while the person's legs and heels of the feet remain on the floor. The Olschewski device shows a vertically adjustable horizontal bar. The Harvey device shows an exercise device for treating an injured knee of a patient lying on his back with the underside of his knee on the support.

SUMMARY OF THE INVENTION

The broad purpose of the present invention is to provide a portable, collapsible, exercise device for treating the knee of a person lying on his back with his leg in a raised position.

An exercise device illustrating this invention comprises a pair of hinged upright supports. A horizontal bar spans the two supports with its ends attached to the supports. The base of each support includes a tubular sleeve connected by a hinge beneath the bar and adjacent to the floor. When the bar is removed, the hinge swings up to a position between the supports as they are moved closely adjacent one another. This position permits the user to readily carry the support and the bar.

When the device is to be used, the two supports are spread by opening the hinge. When the two supports are fully open, the horizontal bar is mounted between them at an adjusted height. The preferred device can be quickly and readily assembled for treatment, easily carried, and inexpensively manufactured.

The preferred embodiment of the invention comprises a tubular frame formed by a pair of spaced generally V-shaped members having their lower ends telescopically received in a pair of U-shaped ground-engaging members. The telescopic connection is such that the V-shaped members can be raised and lowered to a selected height. A bar is supported between the V-shaped members to support the patient's leg in a raised position. This embodiment of the invention can be quickly collapsed into four tubular components and the cross bar.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
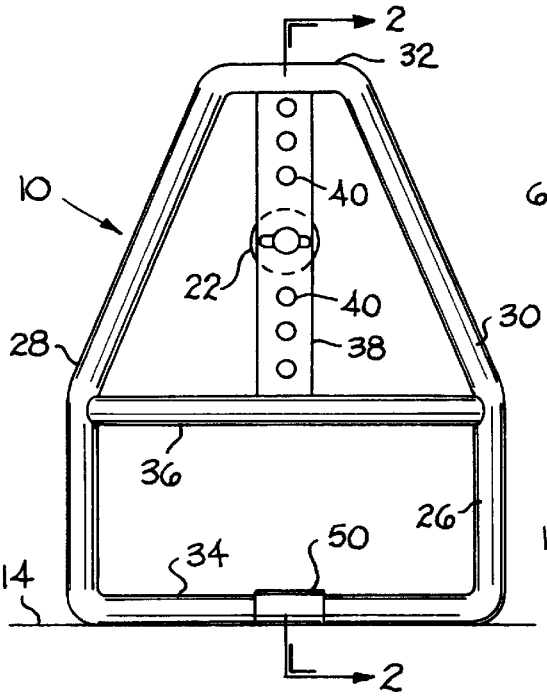
FIG. 1 illustrates an exercise device of the present invention in an upright leg-supporting position.
Figure 2:
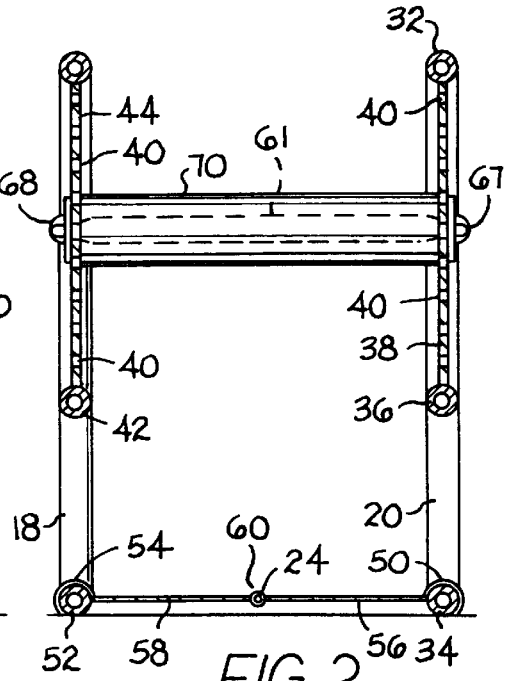
FIG. 2 is a sectional view of the FIG. 1 exercise device taken on line 2—2 in FIG. 1.
Figure 3:
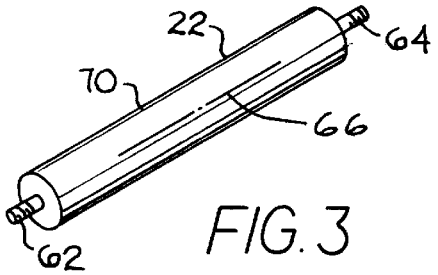
FIG. 3 illustrates the horizontal leg support separated from the main support frame.
Figure 6:
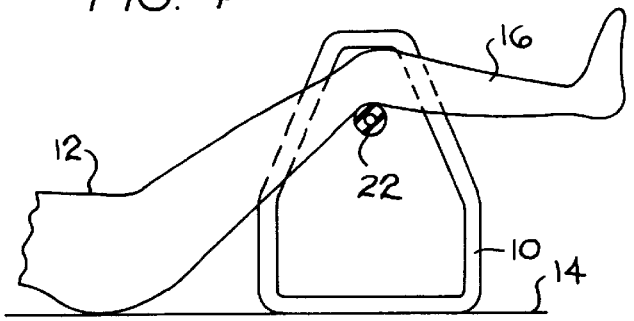
FIG. 6 is an illustration of the manner in which the exercise device is used to treat a patient.

FIGS. 1 and 2 illustrate an exercise device 10 mounted in an upright position for supporting a user in the manner illustrated in FIG. 6. The user or patient 12 lies on floor 14 with leg 16 raised in an upright position and supported on support bar 22 of the exercise device 10.

Device 10 comprises a pair of substantially identical upright support frames 18 and 20, a horizontal support bar 22 and a hinge pin 24. Upright support frame 20 comprises an aluminum tubular frame member 26 bent to form a pair of upright legs 28 and 30 jointed to form an upper end 32. The lower ends of the legs are connected by a horizontal tubular base 34. A horizontal frame member 36 has its ends welded to legs 28 and 30 about 9" above the bottom of base 34. A ¾" wide vertical strap 38 has its upper end welded to upper end 32 and its lower end welded to horizontal frame member 36. Strap 38 is formed with a bright chrome finish. Strap 38 has a vertical series of 9/32" adjustment holes 40 spaced ¾" apart. Similarly, upright support 18 has a horizontal frame member 42 connected to a vertical strap 44 with nine adjustment holes 40 aligned with the holes 40 in strap 38.

Referring to FIG. 2, a sleeve 50 is slideably rotatably mounted on lower base 34. The other upright support 18 also has a lower tubular base 52 supporting a sleeve 54. A plate element or foot 56 extends horizontally from sleeve 50 and can be swung about base 34. Similarly, a plate-type foot 58 has one end welded to sleeve 54 so that the foot can be swung between a horizontal position illustrated in FIG. 2, and an upright vertical position in which both feet are disposed between the legs of the upright support as illustrated in FIG. 4.

Figure 4:
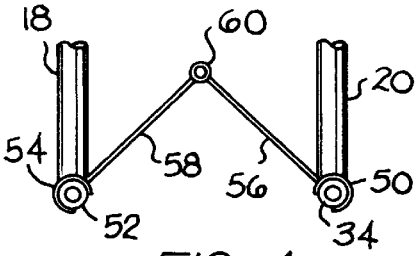
FIG. 4 shows the two upright supports partially collapsed.

A hinge 60 has its ends welded to foot 56 and foot 58, and supports hinge pin 24 in such a manner that by folding the two feet upwardly, the two support frames 18 and 20 are moved toward one another as illustrated in FIG. 4. The two feet can be moved to their uppermost position in which support frames 18 and 20 are closely adjacent one another as illustrated in FIG. 5.

Horizontal support bar 22 preferably has a metal core 61 with a pair of threaded ends 62 and 64 aligned along the longitudinal axis 66 of the bar. The threaded ends 62 and 64 are receivable within a selected pair of aligned holes 40 in the two vertical straps 38 and 44. A wing nut 67 fastens threaded end 64 to strap 38, and a second wing nut 68 fastens the other threaded end to strap 44. The support bar is covered with (or includes) a dense polyurethane foam covering 70 to protect the user's leg. Covering 70 extends the full length of the bar.

In use the exercise device is opened to the position illustrated in FIGS. 1 and 2, and placed on floor 14 as illustrated in FIG. 6. The user's leg is then disposed on top of support bar 22. The bar is on the underside of the knee. The physical therapist can then apply a downward pressure on the raised leg end to exercise the user's knee, or a weight can be suspended from the person's ankle to provide the necessary resistance. The other leg of the person will lie on the floor outside (alongside) the supporting frame.

Figure 5:
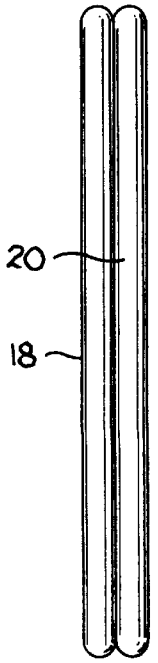
FIG. 5 shows the two upright supports fully collapsed with the bar separated from the support.

When the treatment has been completed, the user unscrews the ends of the support bar from the upright supports and then collapses the device by swinging the hinge pin 24 upwardly so that the two support frames 18 and 20 are closely adjacent one another as illustrated in FIG. 5.

FIGS. 7–10 illustrate the preferred embodiment of the invention which comprises a tubular frame 100 preferably formed of a pair of generally identical inverted V-shaped tubular frame members 102 and 104.

A pair of U-shaped tubular frame members 106 and 108 support the V-shaped members. Frame member 106 has a pair of legs 110 and 112 which telescopically receive the lower ends of tubular legs 114 and 116 of frame members 102 and 104. Similarly, U-shaped frame member 108 has a pair of legs 118 and 120 which telescopically receive the lower ends of legs 122 and 124 of frame members 102 and 104.

Frame members 106 and 108 serve as rigid connectors for the two spaced-apart side members 102 and 104.

Figure 9:
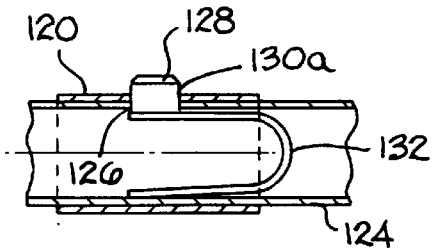
FIG. 9 is an enlarged sectional view showing a typical telescopic connection between the adjustable legs.

FIG. 9 shows a typical telescopic connection between lower leg 120 and leg 124. Leg 124 has an opening 126. A button 128 is slideably mounted in opening 126 and in a selected one of four longitudinally spaced openings 130*a*, 130*b*, 130*c* and 130*d* which are 1⅝" apart. A U-shaped leaf spring 132 inside tubular leg 124 is connected to the button to bias it outwardly. The user adjusts the height of leg 124 by depressing the button until it clears opening 130*a* and moves the two legs with respect to one another to an adjusted height. A similar adjustment connects the other three pairs of telescopic legs.

The two U-shaped frame members 106 and 108 have horizontal midsections 136 and 138 to provide a stable base for a weight disposed on the frame. The horizontal midsections 136 and 138 are each about 12" long.

Figure 8:
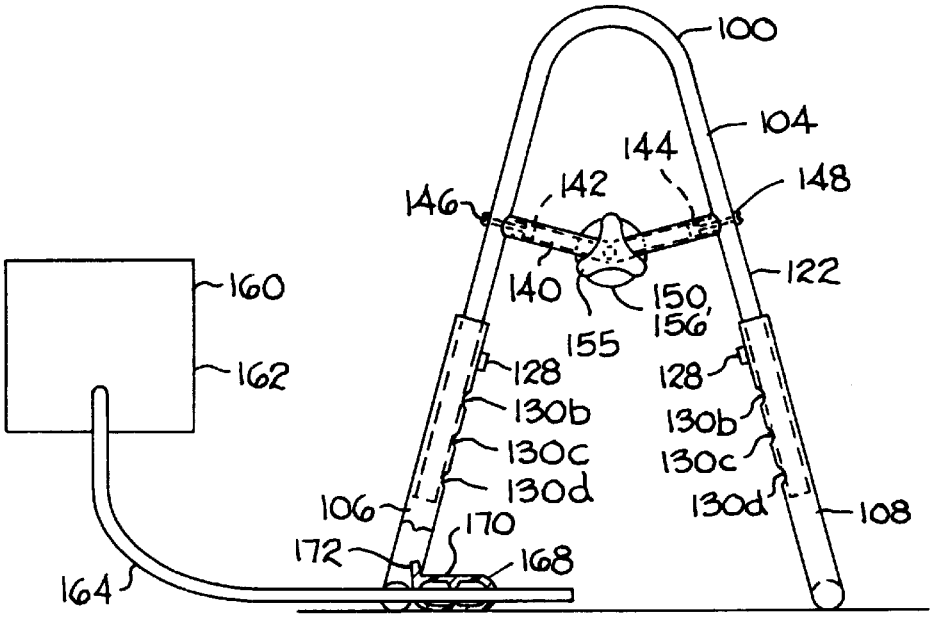
FIG. 8 is a view as seen from the right side of FIG. 7 of the supporting device.

A pair of tubular brace members 140 are mounted between the legs of the V-shaped members as illustrated in FIG. 8. A typical brace member has a mid-section that is bent downwardly. The ends of each brace have internal plugs 142 and 144 which threadably receive a pair of threaded fasteners 146 and 148, respectively to releasably support the brace member between the legs of the associated V-shaped member 102 or 104. Each frame member has an A configuration, as viewed in FIG. 8.

Figure 10:
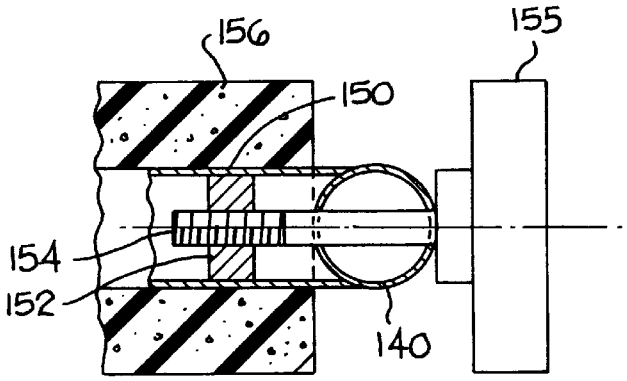
FIG. 10 is an enlarged view showing the manner in which the leg-support cross bar is connected to the V-shaped members.

Referring to FIG. 10, a tubular bar 150 has its ends connected to the two brace members 140. An internal nut 152 at each end of the bar 150 receives a threaded fastener 154 to releasably connect bar 150 to each brace member 140. The ends of the tubular bar 150 are made to be concave so as to have an interlocking fit on brace members 140, as shown in FIG. 10. The bar is about 12½" long. A foam rubber covering 156 having a diameter of about 2" encloses the bar along its length. A larger padded cover, not shown, can be mounted around cover 156 to increase the overall diameter to 4".

The outer end of at least one fastener 154 carries an enlarged head or knob 155 to permit the user to quickly remove fastener 154 when the device is to be collapsed.

The device is used in the same way as illustrated in FIG. 5. The bar supports the underside of the patient's knee about 18"–20" above the ground, depending on the adjusted positions of the connector members 106 and 108 on the legs of V-shaped frame members 102 and 104. Cross bar 150 can be adjusted several inches depending upon the patient's dimensions. The device can be broken down into five major pieces, that is, two V-shaped legs, the two U-shaped frame members 106 and 108, and the leg-support bar 150 which is connected to brace members 140.

Rubber straps can be connected through openings in the lower part of legs 118 and 120 and mounted on the user's legs to provide a form of resistance exercise.

Figure 7:
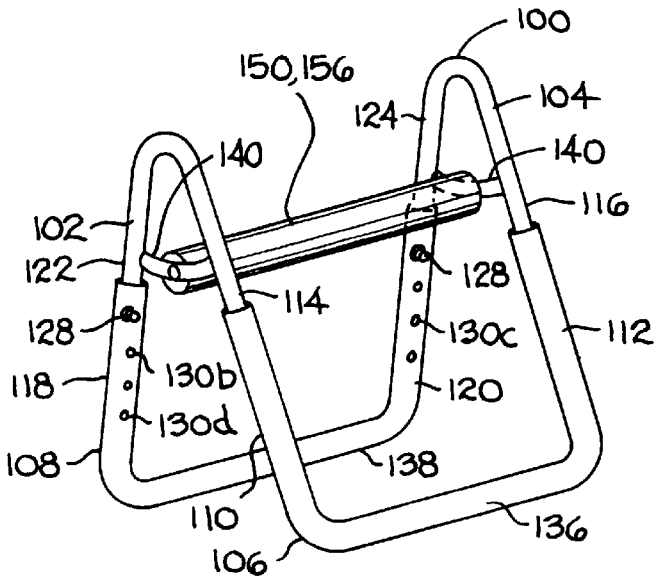
FIG. 7 is a perspective view a preferred embodiment of the invention.
Figure 11:
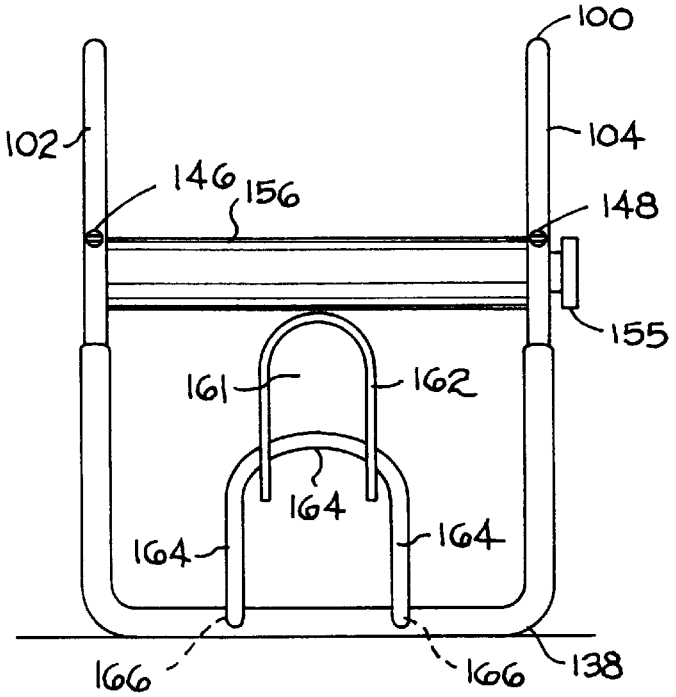
FIG. 11 is a side view of FIG. 8.

FIGS. 8 and 11 show the leg-support device of FIG. 7 equipped with a strap-type resistance member 160 for increasing the effort required to move the lower leg while supported on support bar 150. Resistance member 160 comprises a flexible fabric panel 162 having holes near its opposite ends for receiving a resilient elastomeric tubing 164. End sections of the elastomeric tubing extend through spaced holes 166 in section 136 of frame member 106. A manually-actuable clamp 168 is adjustably connected to each end section of tubing 164 to anchor the tubing end sections to frame member 106.

Each clamp 168 comprises a spring arm 170 and a swingable detent 172 for holding the spring arm in a position wherein the tubing is squeezed between opposed areas of the clamp. The tubing extends through aligned holes in opposite ends of the clamp, whereby the clamp can be slidably adjusted along the tubing when spring arm 170 is separated from detent 172.

As shown in FIG. 8, clamp 168 is locked to the rubber tubing 164, to form an anchorage for the tubing. The clamp can be adjusted along the, tubing to change the anchorage point. Each end section of the tubing is equipped with a clamp-type anchorage of the type shown in FIG. 8.

Resistance member 160 is oriented so that fabric panel 162 can extend upwardly around and over the ankle area of the person using the exercise device; the person's ankle extends through the space designated by numeral 161 in FIG. 11. The rubber tubing is stretched taut by movement of the person's leg against the resistance offered by fabric panel 162 and tubing 164. By adjusting the positions of the clamps 168 on the tubing sections, it is possible to change the tubing anchorage points, and the resultant elongation of the tubing when the person's leg is exercised. The resistance to leg movement is related to the elongation of the rubber tubing. Changing the tubing anchorage points adjusts the tubing elongation and associated resistance to leg movement.

In a second exercise, the person rests his ankle on the padded crossbar 150, 156, and position the fabric panel 162 over (around) his knee. The leg is bent up and down around the knee joint, against the resistance offered by panel 162 and the elastic tubing 164.

In a further exercise activity, the exercise device is placed so that frame member 106 rests on the floor. The person extends his leg through the device so that the knee joint rests on padded cross bar 150, 156, and the heel of the foot is in pressure contact with fabric panel 162, i.e. the fabric panel engages the arch of the person's foot in the fashion of a stirrup. The person can exert a pushing action on fabric panel 162, to exercise the foot and leg muscles. This exercise strengthens the quadricap and hamstring muscles.

The exercise device can be used and adjusted by the patient, without assistance by other people. The patient lies on his back while performing the various exercises. Assembly or disassembly of the exercise device can be accomplished in a relatively easy fashion. The two U-shaped frame members 106 and 108 are separable from frame members 102 and 104. The padded crossbar 150, 156 is separable from frame members 102 and 104. In preferred practice of the invention, the components are formed out of aluminum tubing.

In the preferred practice of the invention, the leg-support bar is a rigid tubular bar covered with an annular foam rubber sleeve, as shown in FIGS. 2 and 10. The outside diameter of the rubber sleeve is at least two inches, whereby the leg-support bar presents a relatively large surface area to the patient's skin area behind the knee joint. The support surface is relatively soft so as to conform to the skin contour while providing a large surface area that reduces unit area forces on the skin surface. The radial thickness of the foam rubber sleeve is preferably at least one half inch.

In the preferred form of the invention depicted in FIGS. 7 through 11, the A-frame structures 102 and 104 combine lightness, strength and rigidity. Frame structures 102 and 104 are interconnected by three widely-spaced cross members 136, 138 and 150 that give the frame structure a desired rigidity without increasing the weight or cost of the exercise device. Cross members 136 and 138 provide a wide-stance support for the device. The upwardly-convergent nature of the inverted V-shaped members 102 and 104 is beneficial in that it tends to minimize the overall size. Portions of members 102 and 104 above leg-support ember 150 tend to prevent the person's leg from slipping off the support member.

In both illustrated embodiments of the invention, the leg-support member 22 or 150 is vertically adjustable to provide a comfortable condition for a range of different patients and a range of different exercises, as previously described. Adjustment of the leg support member can be accomplished relatively easily without special tools.

Having described my invention, I claim:

1. A leg exercise device comprising a framework adapted to rest on a support surface, and a leg-support crosspiece within said framework for positionment above the support surface; said crosspiece comprising a rigid tubular knee-support member and an annular resilient sleeve surrounding said rigid tubular member, whereby the knee area of the persons leg can rest against the outer surface of said resilient sleeve while being supported by said rigid tubular member;

Said framework comprising two A-frame side members spaced in parallel relation, and two U-shaped connector members (106, 108) detachably joining said A-frame side members;

each said A-frame side member comprising an inverted V-shaped tubular frame member that includes an apex tubular section and two downwardly-divergent tubular legs having distal ends, each said A-frame side member further comprising a rigid brace (140) having opposite ends thereof connected to said downwardly divergent tubular legs below the associated apex tubular section and above the distal ends; said tubular knee-support member having opposite ends thereof detachably secured to respective ones of said rigid braces, whereby said crosspiece is located below the apex sections of said A-frame side members and above the distal ends of the divergent tubular legs;

each said U-shaped connector member comprising a bottom midsection portion adapted to rest on the aforementioned support surface, and two upturned tubular end portions adjustably and telescopically fitting the downwardly-divergent legs of the respective A-frame side members; the upturned end portions of said connector members being slidably adjustable on the downwardly-divergent legs of said A-frame members, to adjust the height of said leg-support crosspiece above the support surface.

2. The leg exercise device of claim 1, and further comprising a flexible resistance means connected to a portion of one of said U-shaped connector members for partial encirclement around the person's ankle or foot; said resistance means comprising a fabric panel adapted to extend around the persons' ankle or foot, and two elongated elastic straps connecting said fabric panel to the midsection portion of one of said U-shaped connector members.

* * * * *